US005613933A

United States Patent [19]

Pierce, Jr. et al.

[11] Patent Number: 5,613,933

[45] Date of Patent: Mar. 25, 1997

[54] SHIPPING AND DISPLAY BOX FORMER

[75] Inventors: Chester J. Pierce, Jr., Pioneer; Ronald E. Heiskell, Tracy; Ezra E. Theys, San Mateo, all of Calif.

[73] Assignee: Advanced Container Corporation, Pleasanton, Calif.

[21] Appl. No.: 327,669

[22] Filed: Oct. 21, 1994

Related U.S. Application Data

[63] Continuation-in-part of Ser. No. 192,108, Feb. 4, 1994, abandoned.

[51] Int. Cl.[6] ..... B31B 1/28; B31B 1/52

[52] U.S. Cl. ..... 493/175; 493/176; 493/183; 493/136; 493/137; 493/139; 493/140

[58] Field of Search ..... 493/175, 176, 493/183, 136, 137, 139, 140, 162, 124, 405, 454

[56] References Cited

U.S. PATENT DOCUMENTS

| | | | |
|---|---|---|---|
| 2,863,370 | 12/1958 | Dorfman | 493/137 |
| 2,987,973 | 6/1961 | Chandler | 493/137 |
| 3,400,640 | 9/1968 | Randles | 493/137 |
| 4,173,173 | 11/1979 | Mims | 493/137 |

*Primary Examiner*—Jack W. Lavinder

*Attorney, Agent, or Firm*—Burns, Doane, Swecker & Mathis

[57] ABSTRACT

An apparatus for forming a shipping and display box of the type having diverter tabs that extend outwardly from the box walls is provided that has a guide plate for supporting a blank used for forming the shipping and display box, a catcher plate used for holding the blank on the forming apparatus, a diverter tab lever for extending the diverter tabs outwardly from the box walls, and an actuator for urging the diverter tab lever against the diverter tabs, the actuator allows the catcher plate to be released after the diverter tabs have been extended from the box walls so that the blank can be removed from the forming apparatus. A method of forming the blank into the shipping and display box is also described.

10 Claims, 14 Drawing Sheets

SHIPPING AND DISPLAY BOX FORMER

BACKGROUND OF THE INVENTION

This is a continuation-in-part of application Ser. No. 08/192,108, filed Feb. 4, 1994.

FIELD OF THE INVENTION

The present invention relates to an apparatus for forming shipping and display boxes and, more particularly, to forming shipping and display boxes for fresh products such as asparagus.

STATE OF THE ART

The market for fresh products such as asparagus is widespread, and produce grown in areas such as California finds a market in distant areas such as the Eastern United States as well as in Europe. Produce such as fresh asparagus requires special handling techniques prior to and during shipment to maintain freshness. Typically, fresh asparagus is packed upright, with the bottom ends of the asparagus facing downward and the delicate tips facing upward to prevent damage. An absorbent pad is placed in the bottom of a packing container and is soaked with water for keeping the asparagus moist during transport.

Asparagus, will continue to grow in the packing containers unless it is kept below 60 degrees F. Accordingly, it is common to "hydro-cool" asparagus prior to shipping and to refrigerate the asparagus prior to and during shipping to maintain freshness and prevent growth. In hydro-cooling, the asparagus is soaked with cold water, usually between 34 and 40 degrees F, and the packed asparagus is then taken to a cold room, which is approximately 35 degrees F, before it is shipped in a refrigerated truck. The low temperatures prevent growth of the packed asparagus. Further, it is desirable to provide ample ventilation and water drainage of the asparagus in the packing containers to prevent rot and deterioration.

Such treatment of asparagus has required that the asparagus be shipped in packing containers that are waterproof. Because of the need to soak the packing containers with water in the hydro-cooler prior to and sometimes after transportation, prior corrugated paper or cardboard packing containers have generally not permitted containers on pallets more than one layer high, in part because water in the hydro-cooler is unable to reach the packing containers at the bottom of the pallet and containers within the center of the pallet stack. Further, even where it is possible to stack packing containers on top of one another, the packing containers tend to slide around relative to one another during transportation, usually because of the slick material, such as wax, used to waterproof the material forming the container. The sliding of the packing containers risks damage to the packed products. It is desirable to form a waterproof packing container for shipping of fresh products that is able to provide for hydro-cooling of multiple stacks of packing containers, that offers sufficient ventilation and water drainage to the packed products to prevent the formation of rot and deterioration, that prevents relative movement of stacked packing containers during transportation, and that is able to withstand the force of multiple packed packing containers stacked on top of each other, and the impact forces due to transportation.

Most known packing containers for shipping fresh produce such as asparagus are formed by using staples and straps to hold the walls together. When the packing container reaches its destination, the merchant must generally destroy the packing container to remove the packed products. Further, the use of staples or straps to assemble the packing container is undesirable, at least because of the cost of fasteners, cost of labor to assemble with fasteners, and the cost to maintain the fastener equipment. Some packing containers, such as the shipping and display container shown in U.S. Pat. No. 3,863,829 to Merrill, offer the advantage of permitting a front and top wall of the packing container to be folded back to permit viewing and removal of the packed products. That packing container, however, relies on staples or other fastening means for assembly. Accordingly, it is desirable to have an apparatus to form a packing container that is adapted both for shipping and display of the packed product, and that does not require fasteners for its assembly.

Shipping and display boxes for fresh produce such as asparagus have, in the past, generally been manufactured from corrugated paper or cardboard. When the boxes are formed, they are passed through a shower of wax that provides some degree of water repellency. However, it is difficult to recycle the waxed corrugated paper or cardboard boxes. Further, the waxed corrugated paper or cardboard boxes tend to eventually absorb water and weaken. It is, accordingly, desirable to have an apparatus to form a readily recyclable shipping and display box that does not weaken appreciably when constantly soaked with water, such as during normal transport of hydro-cooled asparagus.

SUMMARY OF THE INVENTION

The present invention, generally speaking, provides an apparatus for forming a packing container or box for shipment and display of fresh products. The apparatus allows a packing container to be formed and assembled without fasteners or straps to hold the container together. Specifically, the apparatus holds a blank used to form the container while it is being formed and then will extend diverter tabs that are important to the hydro-cooling process out from the walls of the container. The forming apparatus is a novel and simple apparatus that is not motorized or electrically operated so that it is inexpensive to build and operate. Likewise, the forming apparatus can be set-up and operated at virtually any location including a produce field.

In accordance with one aspect of the present invention, an apparatus for forming a shipping and display box of the type having diverter tabs that extend outwardly from the box walls, said forming apparatus comprising means for supporting a blank used for forming the shipping and display box, means for holding the blank on the forming apparatus, and means for extending the diverter tabs outwardly from the box walls and releasing the holding means so that the blank can be removed from the forming apparatus.

In accordance with a method aspect of the present invention, a method for forming a shipping and display box of the type having diverter tabs that extend outwardly from the box walls, said method comprising supporting a blank used for forming the shipping and display box in a forming apparatus, folding the blank on the forming apparatus to form the box walls, holding the blank substantially stationary on the forming apparatus, extending the diverter tabs outwardly from the box walls with the forming apparatus, and releasing the blank so that it can be removed from the forming apparatus.

In accordance with another aspect of the present invention, an apparatus for forming a shipping and display box of the type having diverter tabs that extend outwardly from the box walls, said forming apparatus comprising a guide plate for supporting a blank used for forming the shipping and display box, a catcher plate used for holding the blank on the forming apparatus, a diverter tab lever for extending the diverter tabs outwardly from the box walls, and an actuator for urging the diverter tab lever against the diverter tabs, the actuator allows the catcher plate to be released so that the blank can be removed from the forming apparatus.

BRIEF DESCRIPTION OF THE DRAWINGS

The present invention can be further understood with reference to the following description in conjunction with the appended drawings, wherein like elements are provided with the same reference numerals. In the drawings.

DETAILED DESCRIPTION OF THE PREFERRED EMBODIMENTS

Figure 1:
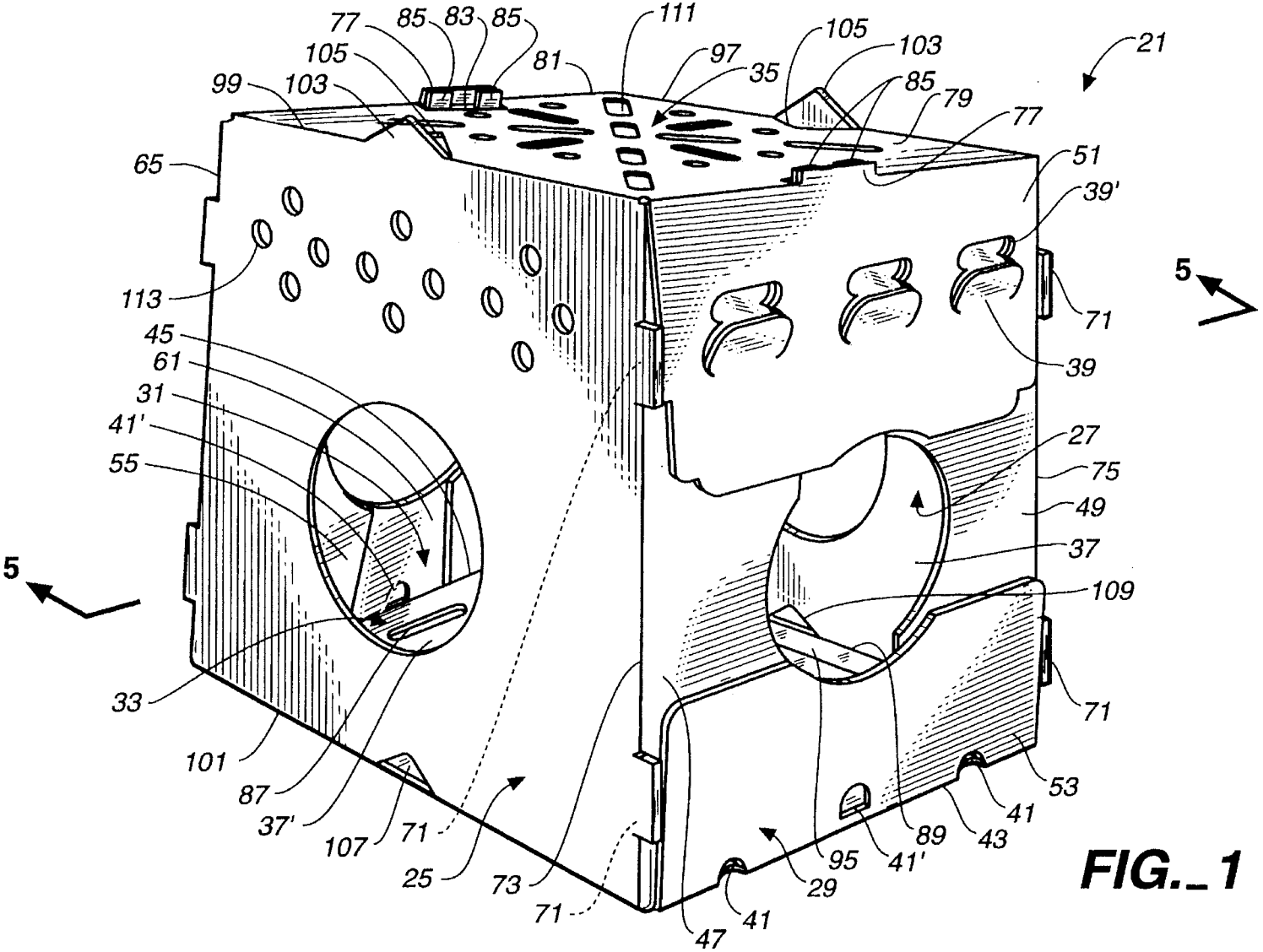
FIG. 1 is a perspective view of a shipping and display box according to an embodiment of the present invention.

A shipping and display box 21 according to an embodiment of the present invention is shown in perspective in FIG. 1. The shipping and display box 21 is preferably formed from a blank 23 such as that shown in FIG. 2 and described further below.

The shipping and display box 21 is preferably made out of a corrugated plastic material having "C-flutes" that are substantially vertical in the finished shipping and display box to provide great compressive strength to the box. The corrugated plastic material is preferably made out of 3 mm high density polypropylene, however, polyethylene may be used instead. The corrugated plastic material is preferably extruded, but may also be a laminated product. The box 21 can, however, be made out of any plastic material, corrugated for flat sheet, that would have similar strength characteristics to corrugated plastic.

Shipping and display boxes 21 according to a preferred embodiment of the invention normally contain approximately fifteen pounds of fresh asparagus and are arranged in stacks 21' of multiple, usually five, boxes. A shipping and display box 21 according to the present invention, manufactured with an extruded corrugated plastic material (3 mm thick polypropylene) was observed to withstand about 457 pounds force, with a deflection of 0.464 inches, which provides a substantial factor of safety under normal conditions, even when all of the shipping and display boxes in a stack are filled to overflowing with water during hydro-cooling. The ability of the shipping and display box 21 to withstand compressive forces is substantially unimpaired during hydro-cooling and transport of produce packed in the box because of the substantially water-impermeable nature of the preferred material for forming the box.

When the contents of the shipping and display box 21 are asparagus, it is desired to maintain a very low temperature of the asparagus to prevent growth of the asparagus, and to prevent rot and deterioration of the asparagus. Accordingly, materials for forming the shipping and display box will desirably not be adversely affected by low temperature. Corrugated plastic possesses this characteristic.

Figure 3:
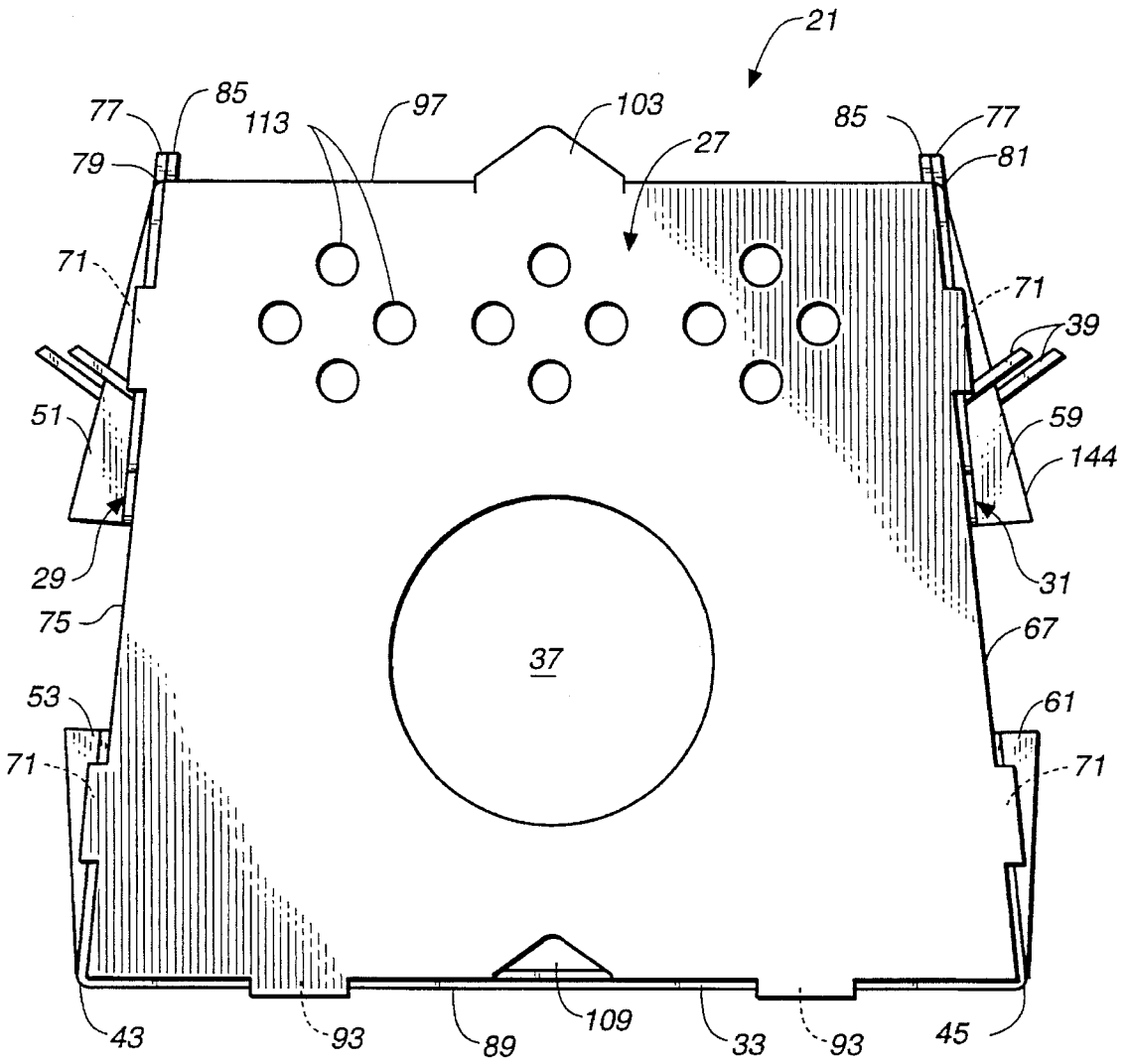
FIG. 3 is a view of a right side wall of a shipping and display box according to an embodiment of the present invention.

As seen in FIG. 1, the shipping and display box 21 is preferably in the form of a truncated pyramid having substantially parallel trapezoidal left and right side walls 25 and 27, respectively (the right side wall is shown in FIG. 3), an upwardly and inwardly sloping front wall 29 (FIG. 4), and an upwardly and inwardly sloping rear wall 31. The front and rear walls 29 and 31, as well as a bottom wall 33 and a top wall 35 (FIG. 6), are preferably substantially square or rectangular. The bottom wall 33 and the top wall 35 are preferably parallel to one another.

The shipping and display box 21 is preferably provided with large holes 37 in each of the left and right side walls 25 and 27, the front wall 29, and the rear wall 31 to facilitate ventilation and watering of the product (not shown), usually fresh asparagus. The shipping and display box 21 is preferably also provided with perforations for forming diverter tabs 39 on each of the front wall 29 and the rear wall 31 for diverting water into the box and for ventilation. The diverter tabs 39 are preferably formed by perforating inverted "U" shapes in the front wall 29 and the rear wall 31 and pushing or pulling the thus-formed substantially half-circle areas away from the walls so that the half-circle areas project away from the walls at an angle. The apparatus of the present invention is used to push the diverter tabs 39 away from the walls as will be described later with reference to FIGS. 8–15.

Figure 7:
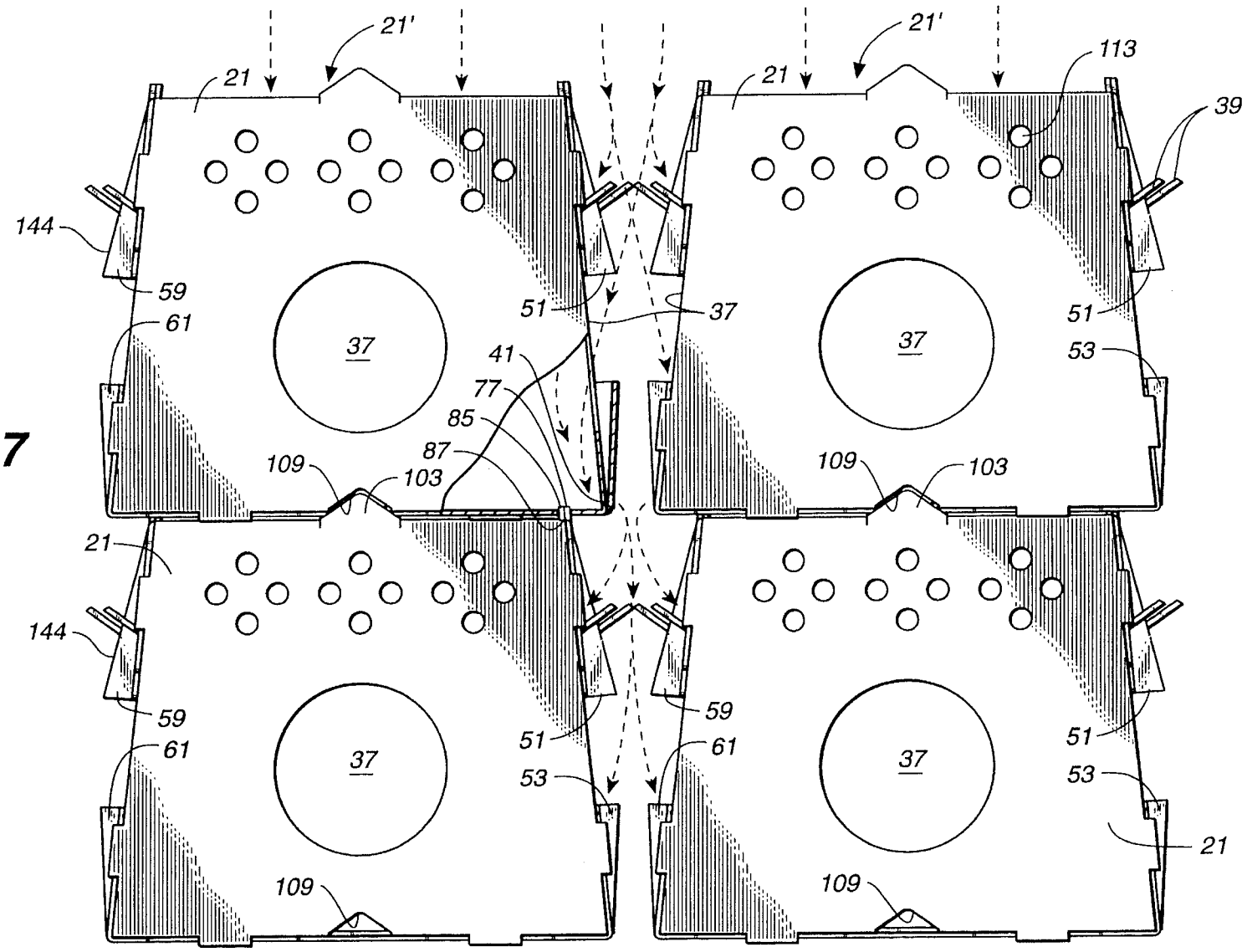
FIG. 7 is a side view of adjacent stacks of shipping and display boxes according to an embodiment of the present invention.

Upper portions 39' of the diverter tabs 39 are preferably removed to facilitate pushing of the diverter tabs away from the front wall 29 and the rear wall 31. Removal of these upper portions 39' of the diverter tabs 39 also facilitates ventilation of the finished shipping and display box 21. Corner drain holes 41 and 41' are provided in the region of the bottom front and bottom rear corners 43, 45 of the shipping and display box 21, directly vertically below each of the diverter tabs 39 to permit water to flow out of the corner drain holes of an upper box and into a lower box upon being diverted into the lower box by the diverter tabs of the lower box, as seen in FIG. 7. Outer corner drain holes 41 preferably extend around the bottom front and bottom rear corners 43 and 45, while central ones of the corner drain holes 41, are disposed substantially only in the front and rear walls 29 and 31, and do not extend past the bottom front or bottom rear corners.

Figure 4:
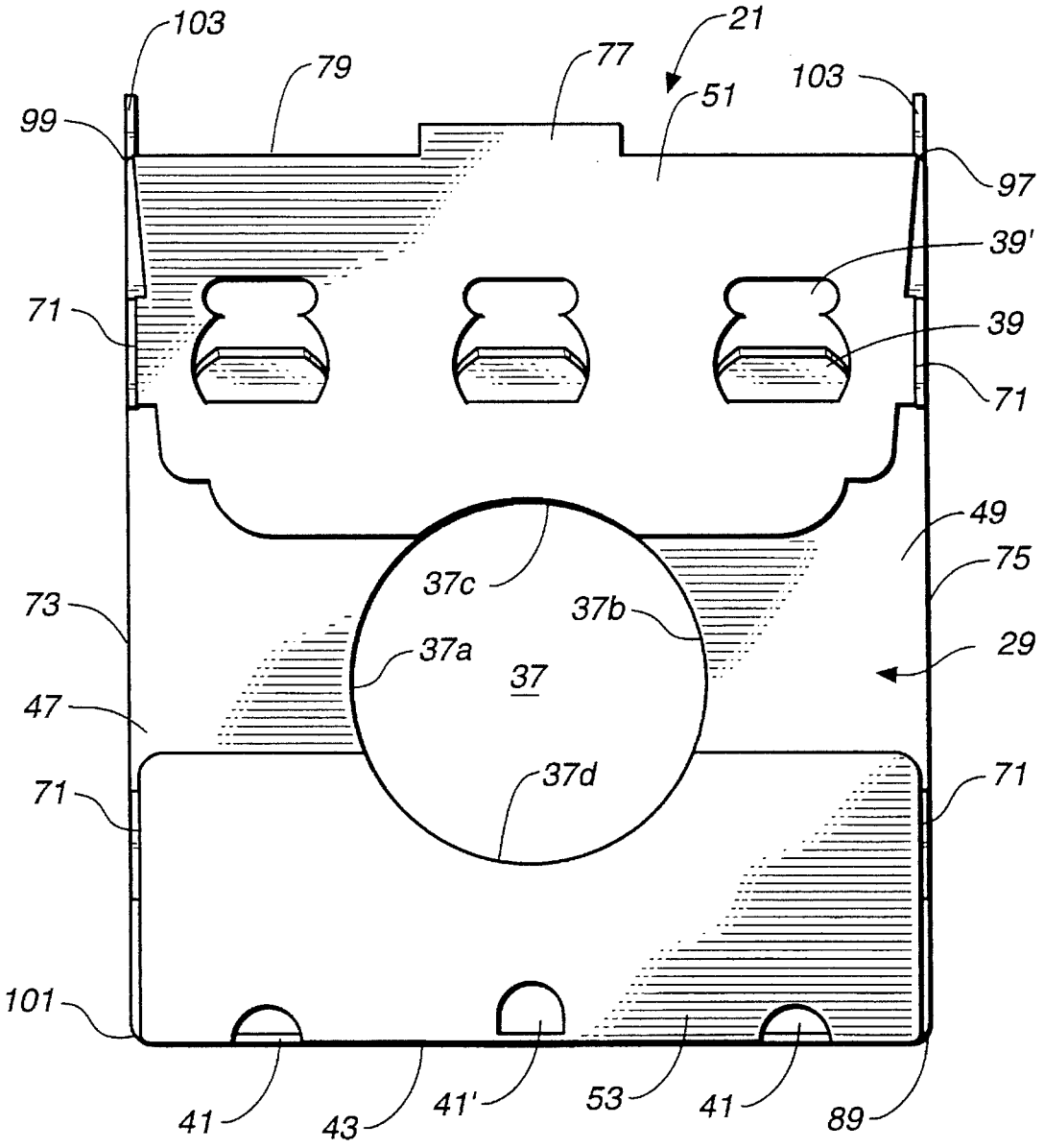
FIG. 4 is a view of a front wall of a shipping and display box according to an embodiment of the present invention.

As seen in FIGS. 1 and 4, the front wall 29 includes a left panel 47, a right panel 49, a top panel 51, and a bottom panel 53. The rear wall 31 similarly includes a left panel 55, a right panel 57, a top panel 59, and a bottom panel 61. The left and right panels 47 and 49 of the front wall 29 and the left and right panels 55 and 57 of the rear wall 31 are folded underneath the top and bottom panels 51 and 53 of the front wall and the top and bottom panels 59 and 61 of the rear wall, respectively. As seen in FIG. 1 and 4, the diverter tabs 39 are provided in the top panel 51 of the front wall 29. Diverter tabs 39 are similarly provided in the top panel 59 of the rear wall 31.

Figure 5:
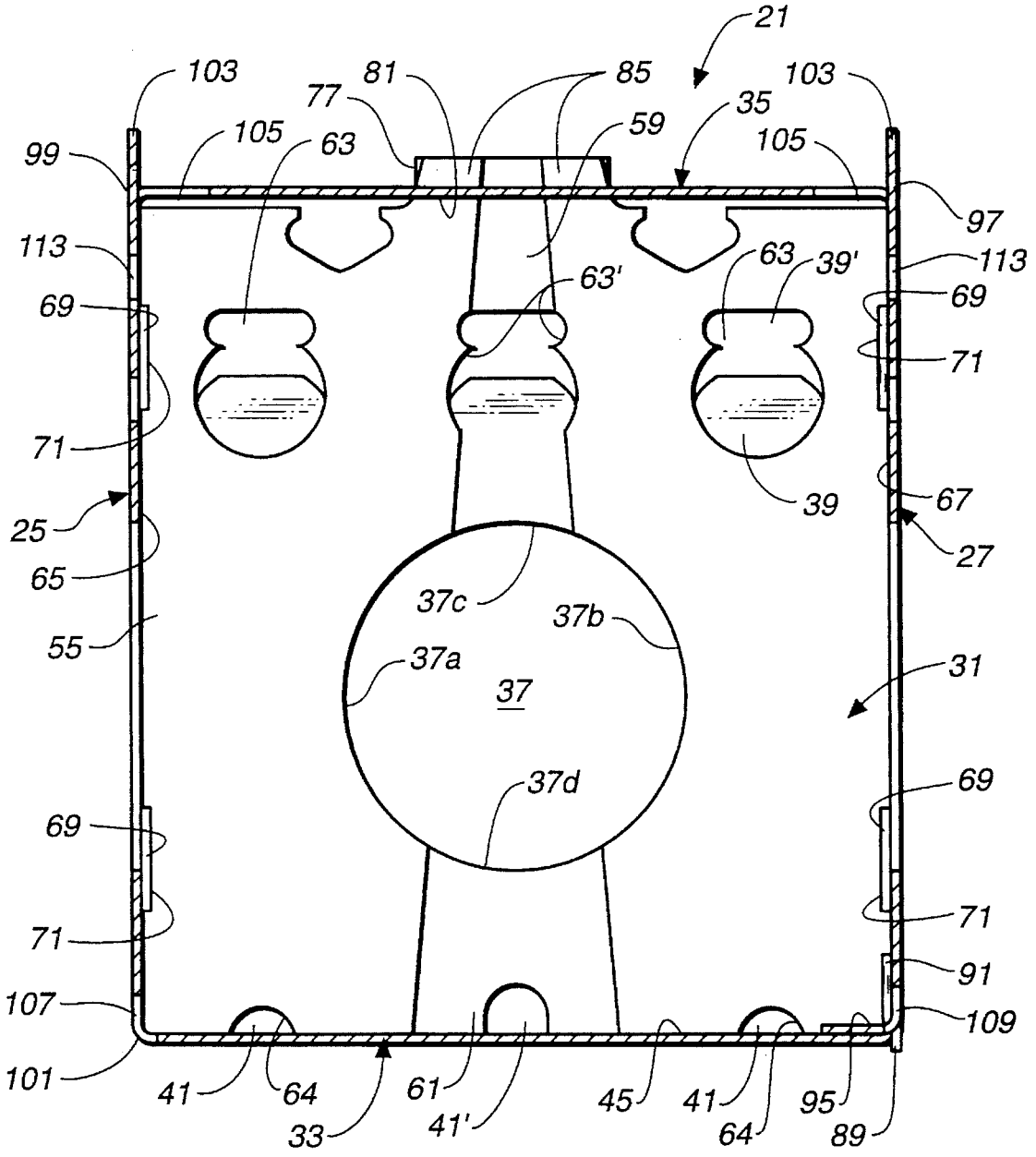
FIG. 5 is a cross-sectional side view of the shipping and display box of FIG. 1, taken at section 5—5 of FIG. 1.

As seen in FIG. 5, the left panel 55 of the rear wall is provided with a hole 63 disposed adjacent to the diverter tab 39 nearest the rear left side corner 65 of the shipping and display box 21. Recesses 63' are provided along edges of the left and right panels 55 and 57 of the rear wall 31 adjacent to a center diverter tab 39 on the top panel 59. The right panel 57 of the rear wall 31 is provided with a hole 63 disposed adjacent to the diverter tab 39 nearest the rear right side corner 67 of the shipping and display box 21. The holes 63 and recesses 63' permit water diverted into holes formed by the diverter tabs 39 to enter the interior of the shipping and display box 21. Similar holes 63 and recesses 63' are provided in the left and right panels 47 and 49 of the front wall 29.

The left and right panels 47 and 49 of the front wall 29 and the left and right panels 55 and 57 of the rear wall 31 are provided with recesses 64 at bottom edges of the panels. The recesses 64 align with the outer corner drain holes 41 to facilitate the flow of water out of the outer corner drain holes.

Figure 2:
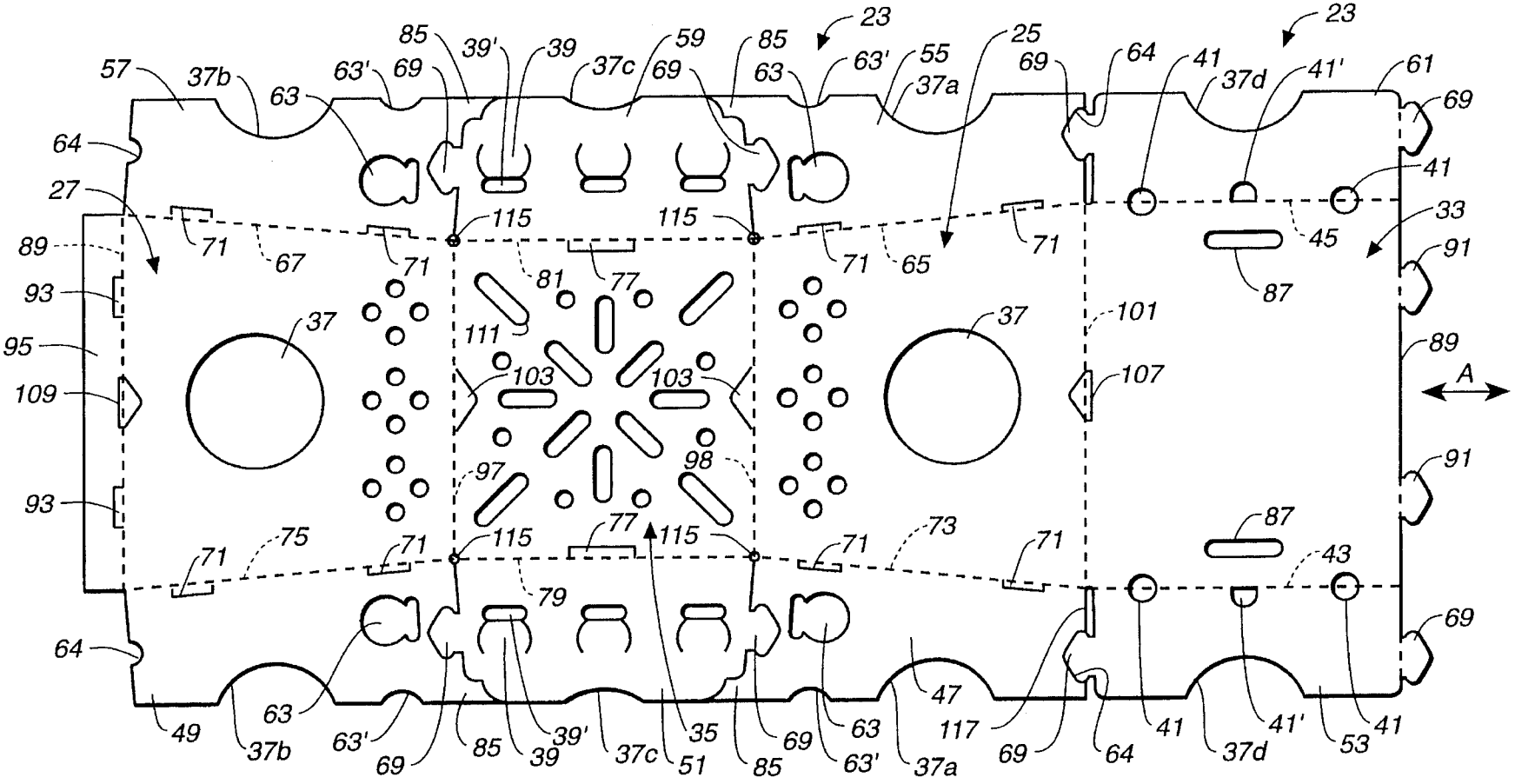
FIG. 2 is a top plan view of a blank for forming a shipping and display box according to an embodiment of the present invention.

The top and bottom panels 51 and 53 of the front wall 29 and the top and bottom panels 59 and 61 of the bottom wall 31 are each provided with arrow-shaped tabs 69, seen on the blank 23 shown in FIG. 2, on right and left sides of the top and the bottom panels. The tabs 69 are also seen inside of the shipping and display box 21 in FIG. 5. The tabs 69 on the top and bottom panels 51 and 53 of the front wall 29 are received in slots 71 provided at the front left side corner 73 and at the front right side corner 75 of the shipping and display box 21. The tabs 69 on the top and bottom panels 59 and 61 of the rear wall 31 are received in slots 71 provided at the rear left side corner 65 and at the rear right side corner 67 of the shipping and display box 21. As noted above, the tabs 69 are preferably arrow-shaped. The "arrow-head" portions of the tabs 69 are preferably sufficiently wider than the slots 71 such that, upon being forced into the slots, the tabs are only removed with difficulty, thereby ensuring that the shipping and display box 21 remains in an assembled condition.

The holes 37 provided in the front wall 29 and the rear wall 31 are formed upon formation of the front wall. The left panels 47 and 55 of the front wall 29 and the rear wall 31, respectively, are each provided with a recess 37*a* at right edges. The right panels 49 and 57 of the front wall 29 and the rear wall 31, respectively, are each provided with a recess 37*b* at left edges. The top panels 51 and 59 of the front wall 29 and the rear wall 31, respectively, are each provided with a recess 37*c* at bottom edges. The bottom panels 53 and 61 of the front wall 29 and the rear wall 31, respectively, are each formed with a recess 37*d* at top edges. When the panels forming the front and rear walls 29 and 31 are locked in place, the recesses 37*a*, 37*b*, 37*c*, and 37*d* define the hole 37.

As seen in FIGS. 1 and 3–7, stacking tabs 77 protrude upwardly from the top front corner 79 and the top rear corner 81 of the shipping and display box 21. The stacking tabs 77 are preferably formed upon folding the top panels 51 and 59 of the front and rear walls 29 and 31, respectively, relative to the top wall 35 when forming the shipping and display box 21 by providing the blank 23 for forming the shipping and display box with substantially U-shaped slots at points corresponding to the top front corner 79 and the top rear corner 81. Upon folding the top panels 51 and 59 relative to the top wall 35, the stacking tabs 77 protrude upwardly and also form openings 83 on the top wall adjacent the stacking tabs. Tabs 85 provided on upper edges of the left and right panels 47 and 49 of the front wall 29 and the left and right panels 55 and 57 of the rear wall extend through the openings 83 to secure the left and right panels of the front and rear walls relative to the top wall 35 and to strengthen the stacking tabs 77.

Stacking holes 87 are provided in the bottom wall 33 proximate the bottom front corner 43 and the bottom rear corner 45. The stacking holes 87 are disposed substantially vertically below the stacking tabs 77 and the tabs 85 on the left and right panels of the front and rear walls such that, as seen in FIG. 7, the stacking holes of a shipping and display box 21 stacked on top of another box receive the stacking tabs of the lower box, thereby aligning the two boxes relative to one another and preventing relative movement of the two boxes. The alignment of stacked shipping and display boxes 21 provided by the stacking tabs 77 and the stacking holes 87 watering of lower boxes with water flowing through the corner drain holes 41 and 41' of upper boxes into the lower boxes through the holes formed by the diverter tabs 39 that are vertically aligned with the corner drain holes. The central corner drain holes 41' preferably do not extend past the front and rear bottom corners 43 and 45 in order to provide additional strength to the portion of the shipping and display box 21 between the central corner drain holes and the stacking holes 87.

Figure 6:
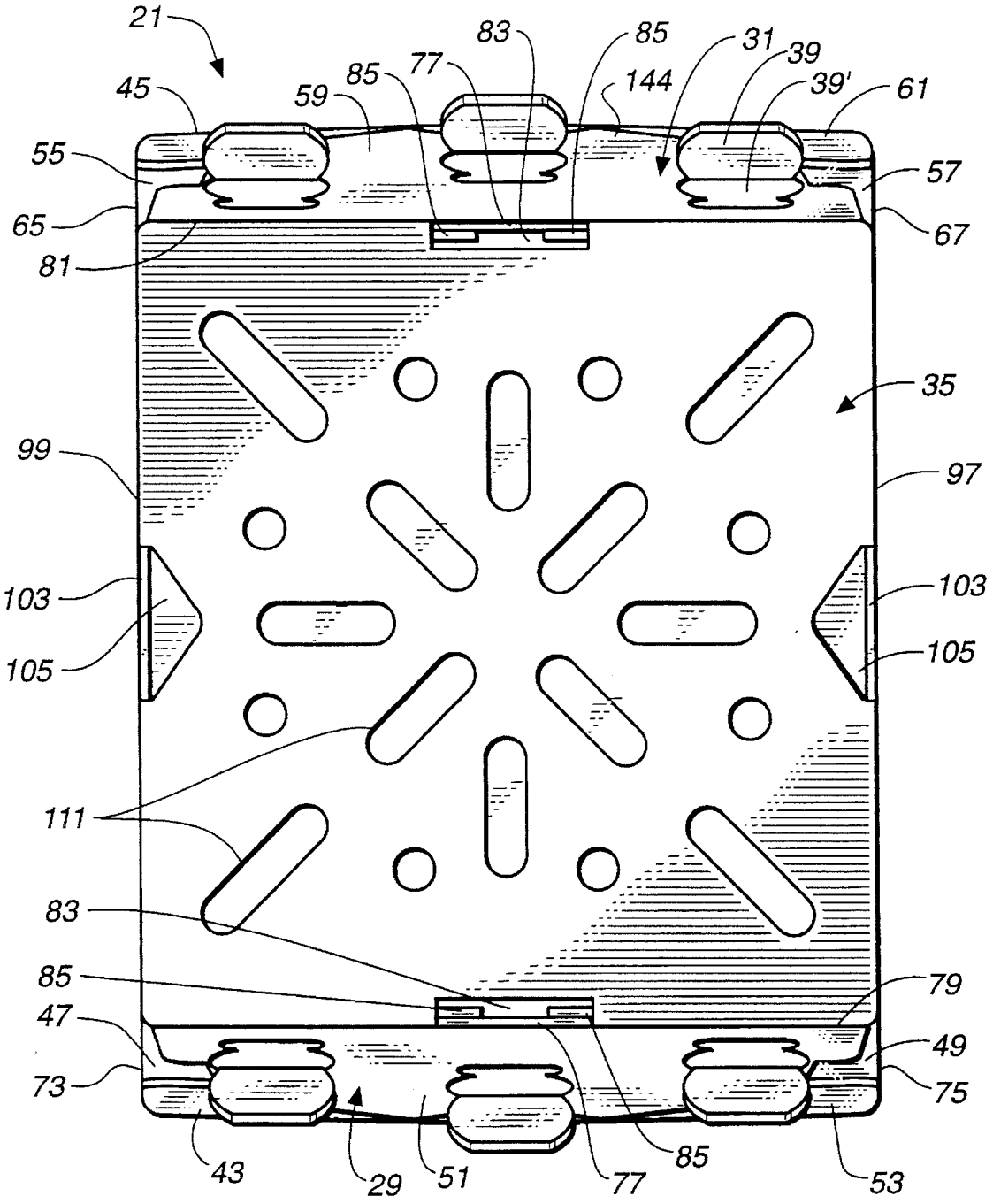
FIG. 6 is a top view of a shipping and display box according to an embodiment of the present invention.

As seen with reference to FIGS. 3, 6, and 7, the top and bottom panels 51 and 53 of the front wall 29 and the top and bottom panels 59 and 61 of the rear wall 31 preferably bow outwardly. As seen in FIG. 7, the outward bowing of the top and bottom panels facilitates water flow off of top panels of the shipping and display boxes 21 of one stack 21' of boxes into the holes 37 provided in the front or rear walls 29 or 31 of boxes in adjacent stacks, the outwardly bowed bottom panels facilitating capture of such water flow. The outward bowing of the top and bottom panels is preferably provided by virtue of the "memory" of the top and bottom panels, which would tend to unfold relative to the top and bottom walls 33 and 35 but are restrained at the left and right edges of the top and bottom panels by the tabs 69 and slots 71. Center portions of the top and bottom panels, which are not fastened down, tend to push outward as the top and bottom panels try to unfold, causing the top and bottom panels to bow outward at their centers, relative to the constrained left and right edges. The arrow-shaped tabs 69 include a short "shaft" portion between the "arrow-head" portion of the tabs and the left and right edges of the top and bottom panels to provide a greater overall width to the top and bottom panels, thereby further facilitating the outward bowing of those panels.

As seen in FIGS. 1 and 5, a bottom edge of the right side wall 29 is attached to a right edge of the bottom wall 33 at the bottom right side corner 89 of the shipping and display box 21 by arrow-shaped tabs 91 provided on the right edge of the bottom wall that are received in slots 93 provided in a flap 95 on the bottom edge of the right side wall. The flap 95 is folded around the bottom fight side corner adjacent an inner side of the bottom wall 33, and the tabs 91 are folded around the bottom right side corner adjacent an inner side of the right side wall 29. The width of a head portion of the tabs 91 is preferably greater than the width of the slots 93 to inhibit unintended withdrawal of the tabs.

The top right side corner 97 is preferably formed by folding the right side wall 29 relative to the top wall 35. The top left side corner 99 is preferably formed by folding the left side wall 27 relative to the top wall. The bottom left side corner 101 is preferably formed by folding the left side wall relative to the bottom wall 33.

Upwardly extending side stacking or registration tabs 103 are preferably provided at the top left side corner 99 and the top right side corner 97. The side registration tabs 103 are preferably formed by providing V-shaped slots on the top wall 35 with an open side of the "V" adjacent the top left side corner 99 and the top right side corner 97. Upon folding the left side wall 27 and the right side wall 29 relative to the top wall 35, the registration tabs 103 extend upwardly and a V-shaped opening 105 is formed adjacent the tabs.

A left side registration hole 107 and a right side registration hole 109 are formed vertically below the registration tabs 103 in the left and right side walls 27 and 29, respectively, extending upwardly from the bottom left side corner 101 and the bottom right side corner 89, respectively. Registration tabs 103 of a lower box are received in the registration holes 107 of an upper box stacked on top of the lower box. The registration holes 107 and registration tabs 103 facilitate proper alignment and prevent movement of stacked boxes in a similar fashion to that described above with regard to the stacking tabs 77 and the stacking holes 89. Further, the visible registration holes 107 and registration tabs 103 facilitate properly orienting two shipping and display boxes 21 for insertion of the stacking tabs 77 of a lower box into the stacking holes 89 of an upper box, the stacking tabs 77 and the stacking holes 89 both normally being concealed by the upper box.

Ventilation and watering holes 111 are preferably provided on the top wall 35. The ventilation and watering holes 111 facilitate ventilation and watering of top boxes in stacks 21' of boxes. The ventilation and watering holes 111 of lower ones of the boxes 21 in the stack 21' are generally covered by upper boxes. Side ventilation holes 113 are preferably provided in the left and fight side walls 27 and 29 to facilitate ventilation of boxes. When stacks 21' of boxes 21 are arranged adjacent to one another on pallets, the side ventilation holes 113 of boxes in adjacent stacks are adjacent or nearly adjacent to one another, thereby facilitating air flow. Also, apertures 39' and 39 facilitate air flow through the box.

As seen in FIG. 7, when shipping and display boxes 21 are arranged in stacks 21' and upper ones of the shipping and display boxes are watered, water enters the upper one of the boxes through the holes 37 in the front and rear walls as water cascades off of the outwardly bowing top panels of the front and rear walls of boxes in adjacent stacks, through the ventilation and watering holes 111, and through the holes formed by the diverter tabs 39. The water flows out of the boxes through the corner drain holes 41 and 41'. The boxes are preferably filled with water up to the bottoms of the holes 37, at which point the water flows out of the boxes through those holes, as well as through the corner drain holes.

The water cascades out of the upper boxes onto the top panels of the front and rear walls 29 and 31 of lower boxes. The water on the top panels is diverted into the lower boxes by the diverter tabs 39 or cascades off of the bottom edges of the top panels. Some of the water that cascades off of the bottom edges of the top panels enters boxes in adjacent stacks through the holes 37 in the front or rear walls of those boxes.

As noted above, each shipping and display box 21 is preferably in the form of a truncated pyramid in which the front and rear walls 29 and 31 slope inwardly and upwardly. As seen in FIG. 7, when stacks 21' of boxes 21 are positioned relative to one another so that the front or rear walls 29 or 31 of the shipping and display boxes of one stack are adjacent the front or rear walls of the shipping and display boxes of another stack, a substantially triangular or wedge-shaped space is formed between the shipping and display boxes of the two stacks.

The wedge-shaped space permits the diverter tabs 39 to extend outwardly from the front and rear walls 29 and 31 without interference from other surfaces, such as diverter tabs on other boxes. Further, the space formed between adjacent stacks 21' of shipping and display boxes facilitates air flow through and around the boxes to keep the produce packed in the boxes fresh. Features such as the diverter tabs 39, the corner drain holes 41, and the inwardly and upwardly sloping front and rear walls 29 and 31 of the shipping and display box 21 facilitate the watering of multiple stacks of boxes by simply watering an uppermost level of the stacks of boxes and allowing the water to flow down through to lowermost ones of the boxes.

The holes provided by the diverter tabs 39 and the ventilation holes 111 and 113 are all smaller in diameter than the large holes 37. By providing the smaller holes 39, 111, and 113 in a top portion of the shipping and display box 21, a venturi effect is created when the refrigerated, cooler air in the box absorbs heat from the product inside the box, rises to the top of the box, and then passes out of the smaller holes at the upper part of the box. When this warmer air moves out through these smaller holes, the air increases in velocity. This is shown by the mass flow rate equation:

$$Q=pVA$$

where Q is the mass flow rate, p is the mass density, V is the velocity, and A is the cross-sectional area of the orifice.

As the area of an orifice through which a particular volume of air passes in a given time decreases, the velocity of the air increases. Accordingly, as the velocity of the air flow increases through the smaller cross-sectional holes 39, 111, and 113, the venturi effect is understood to result in more air being pulled into the box through the larger, less restricted, ventilation holes 37. This can be represented by the continuity equation:

$$Q=(VA)1=(VA)2$$

where (VA)1 is the velocity of air flow multiplied by the area of the larger hole, and (VA)2 is the velocity of air flow multiplied by the area of the smaller hole. The foregoing assumes that mass density of air is substantially constant, which is a reasonable assumption as velocity and pressure changes of air during normal use hydro-cooling of the contents of the shipping and display box are understood to be minimal.

As seen in FIG. 2, the shipping and display box 21 described above is preferably formed from a single piece blank 23. For purposes of reference, FIG. 2 is considered to show an inner side of the blank 23 which would be disposed on an inside of the shipping and display box 21, although it will be understood that the blank could be considered to be illustrating an outer side of the blank. As noted above, the box forming material is preferably a corrugated plastic material. The C-flutes of the material are preferably arranged in the direction of the arrow A to provide maximum compressive strength to the shipping and display box 21.

The blank 23 is preferably arranged such that the fight side wall 27 is hinged to, i.e., folded at, the top wall 35 at the top right side corner 97, the top wall is hinged to the left side wall 25 at the top left side corner 99, and the left side wall is hinged to the bottom wall 33 at the bottom left side corner 101. The flap 95 is hinged to the right side wall 27 at the bottom right side corner 89 on a left side of the blank 23 and the flaps 91 are hinged to the bottom wall 33 at the bottom right side corner 89 on a right side of the blank.

The left panels 47 and 55 of the front and rear walls 29 and 31, respectively, are hinged to the left side wall 25 at the front left side corner 73 and the rear left side corner 65, respectively. The right panels 49 and 57 of the front and rear walls 29 and 31, respectively, are hinged to the right side wall 27 at the front right side corner 75 and the rear right side corner 67, respectively. The top panels 51 and 59 of the front and rear walls 29 and 31, respectively, are hinged to the top wall 35 at the top front corner 79 and the top rear corner 81, respectively. The bottom panels 53 and 61 of the front and rear walls 29 and 31, respectively, are hinged to the bottom wall 33 at the bottom front corner 43 and the bottom rear corner 45, respectively.

The arrangement of the panels of the front and rear walls 29 and 31 relative to the left and right side walls 25 and 27, the top wall 35, and the bottom wall 33 facilitates forming the shipping and display box 21 such that at least portions of all of the vertical walls include vertical flutes of the corrugated material for forming the box. The vertical flutes provide great strength to the box 21 in compression. For example, when the flutes run in the direction A, the flutes run from top to bottom on the left and right side walls 25 and 27. The flutes also run from top to bottom on the left and right panels 47 and 49 of the front wall 29 and on the left and right panels 55 and 57 of the rear wall 31.

The blank 23 is preferably formed such that the tabs 69 at the left edges of the bottom panels 53 and 61 of the front and rear walls 29 and 31, respectively, are cut from material at bottom edges of the left panels 47 and 55 of the front and rear walls. In this manner, the cuts or perforations of the material at the bottom edges of the left panels 47 and 55 to form the tabs 69 define the recesses 64 that allow flow through the corner drain holes 41 at the bottom front corner 43 and the bottom rear corner 45 nearest the left side wall 27.

The shipping and display box 21 may be formed from the blank 23 with reference to FIGS. 8-15 as follows. As can best be seen in FIG. 8, the forming apparatus 120 comprises a left forming side plate 122 and a right forming side plate 124 connected by cross spacers 126. At the back of the forming apparatus 120 is a back plate mounting 128 for connecting to a support member 130 used to mount the forming apparatus 120 on a work stand or similar mounting that positions the forming apparatus at a comfortable height for a worker using the apparatus.

Figure 8:
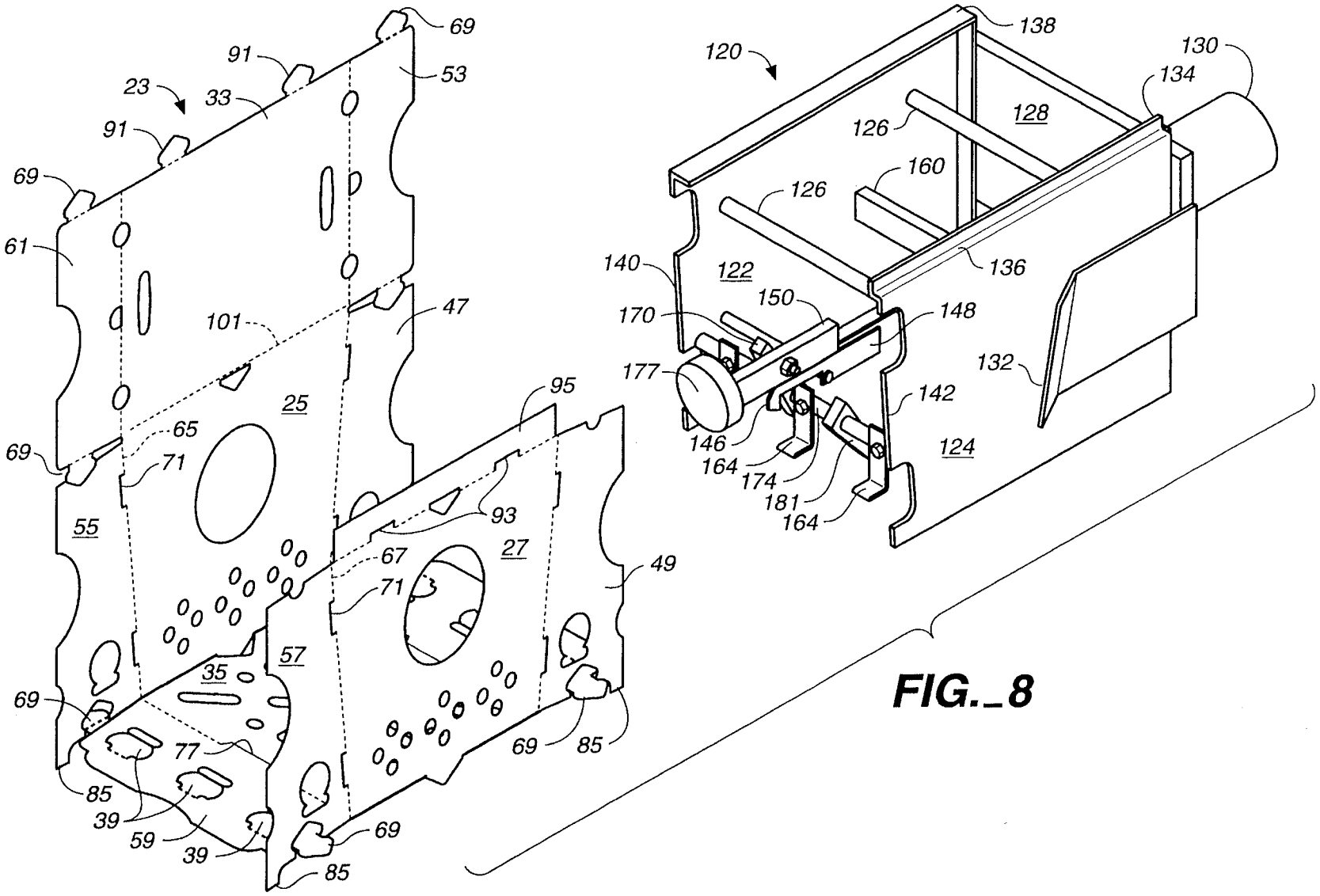
FIGS. 8–11 are perspective views showing the assembly of a shipping and display box with a forming apparatus according to an embodiment of the present invention.

On either side of the forming apparatus 120 is a container insert guide 132. As seen in FIG. 8, the blank 23 is folded into a U-shape by a user with the top wall 35 at the bottom of the "U" with the top panel rear wall 59 closest to the user (i.e., at the end opposite of the forming apparatus), the left side wall 25 on the left side of the "U" and the right side wall 27 on the right side of the "U". Folding of the blank 23 is facilitated by the fold lines 97, 99 and 101. The user then slides the U-shaped blank 23 (FIG. 9) between the outside surface of the left forming side plates 122 and 124 and the inside surface of the container insert guide 132 located on each side of the forming apparatus 120 and the bottom guide plate 133. The container insert guides 132 and bottom guide plate 133 hold the blank 23 around the forming apparatus 120.

After the U-shaped blank 23 is slid completely onto the forming apparatus 120, the user first folds flap 95 over the top edge 134 of right forming side plate 124. Then bottom wall 33 is folded over the flange 138 on the top edge of the left forming side plate 122. The tabs 91 are inserted into the slots 93 so that the tabs and the flap 95 are both disposed on the inner side of the substantially rectangular tube formed by inserting the tabs into the slots. The top edge 134 has a "jog" 136 in it to facilitate the tabs 91 being inserted into the slots 93.

The left and right panels 55 and 57 of the rear wall 31 are folded relative to the rear left and right side corners 65 and 67 over the edges 140 and 142, respectively, of the left forming side plate 122 and right forming side plate 124. The tabs 85 on the upper edges of the left and right panels are inserted into the opening 83 at the top rear corner 81 formed by the stacking tab 77.

Figure 9:
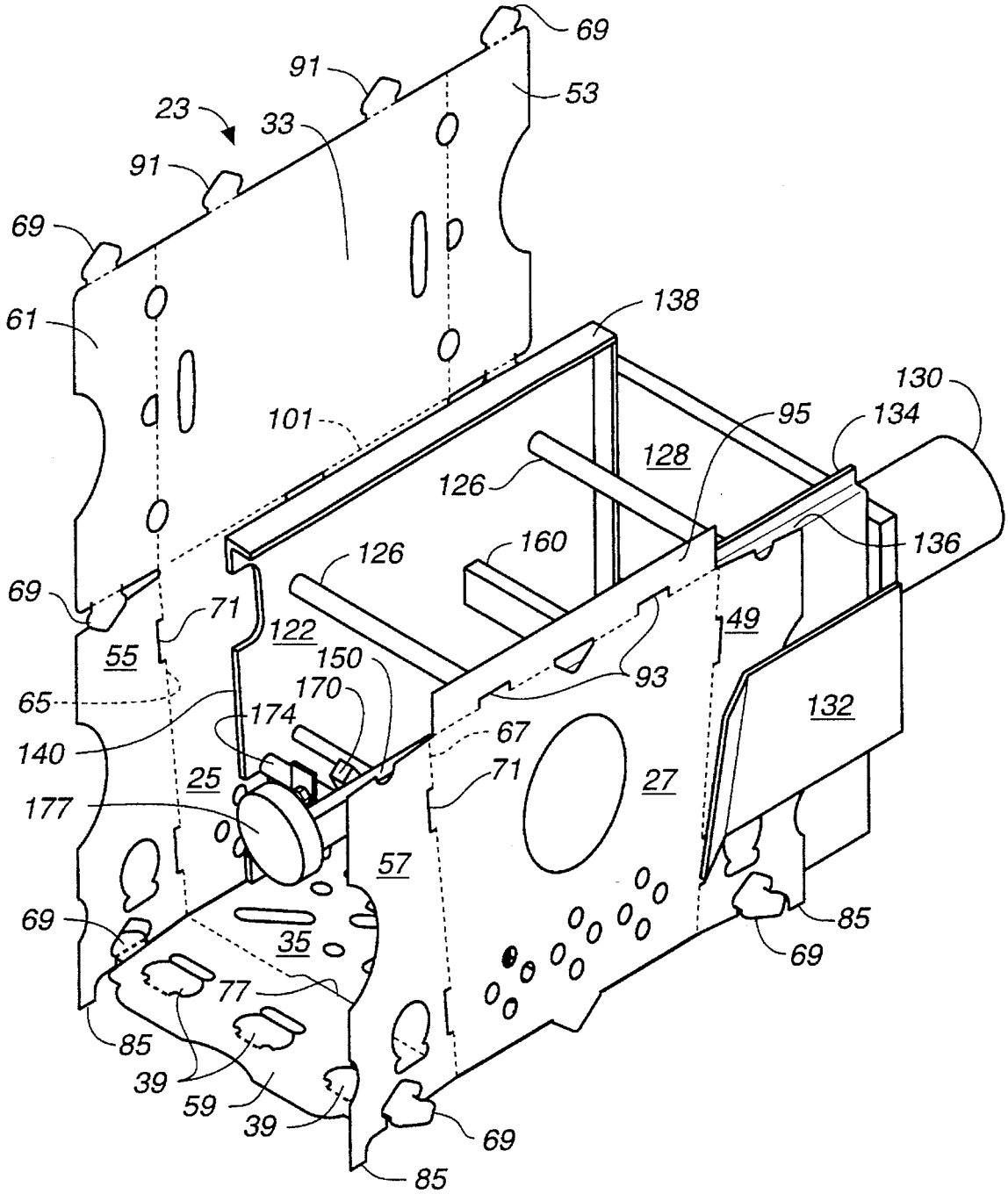
Figure 10:
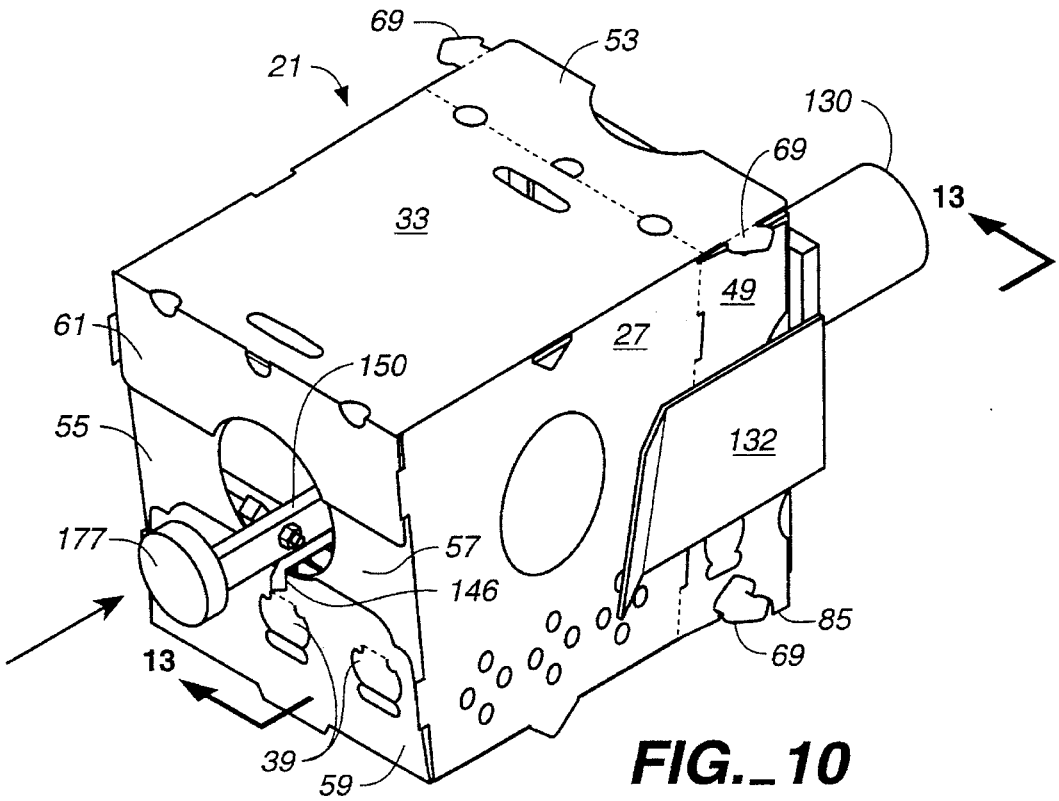
Figure 11:
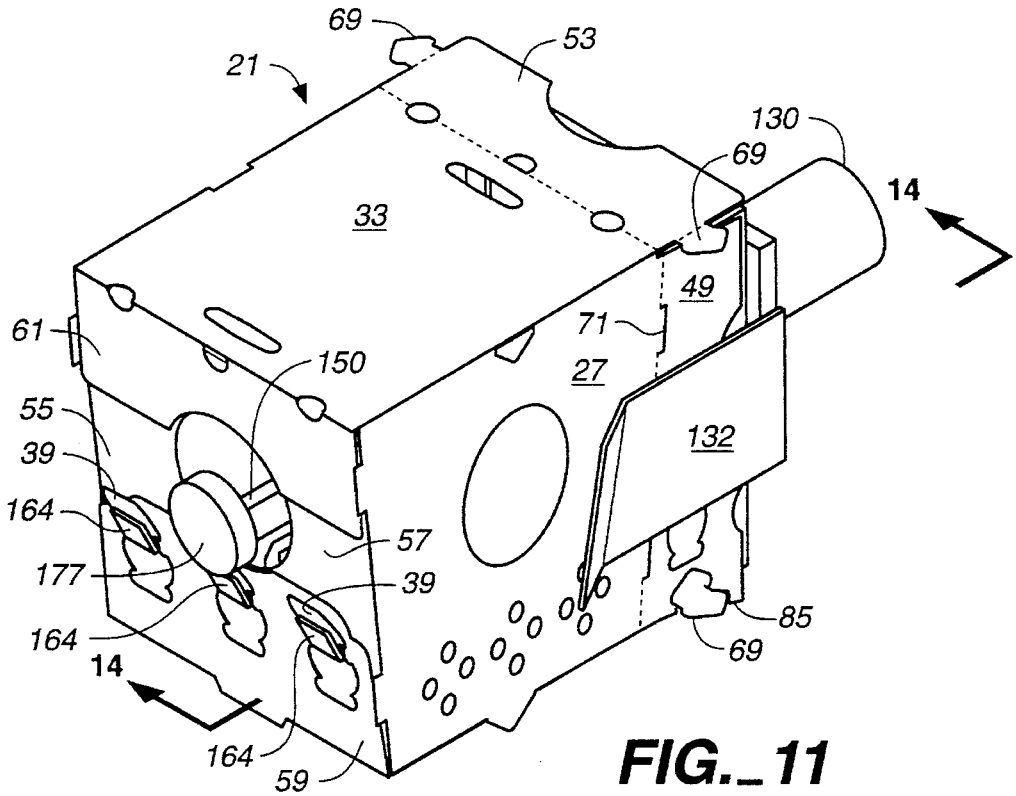
Figure 12:
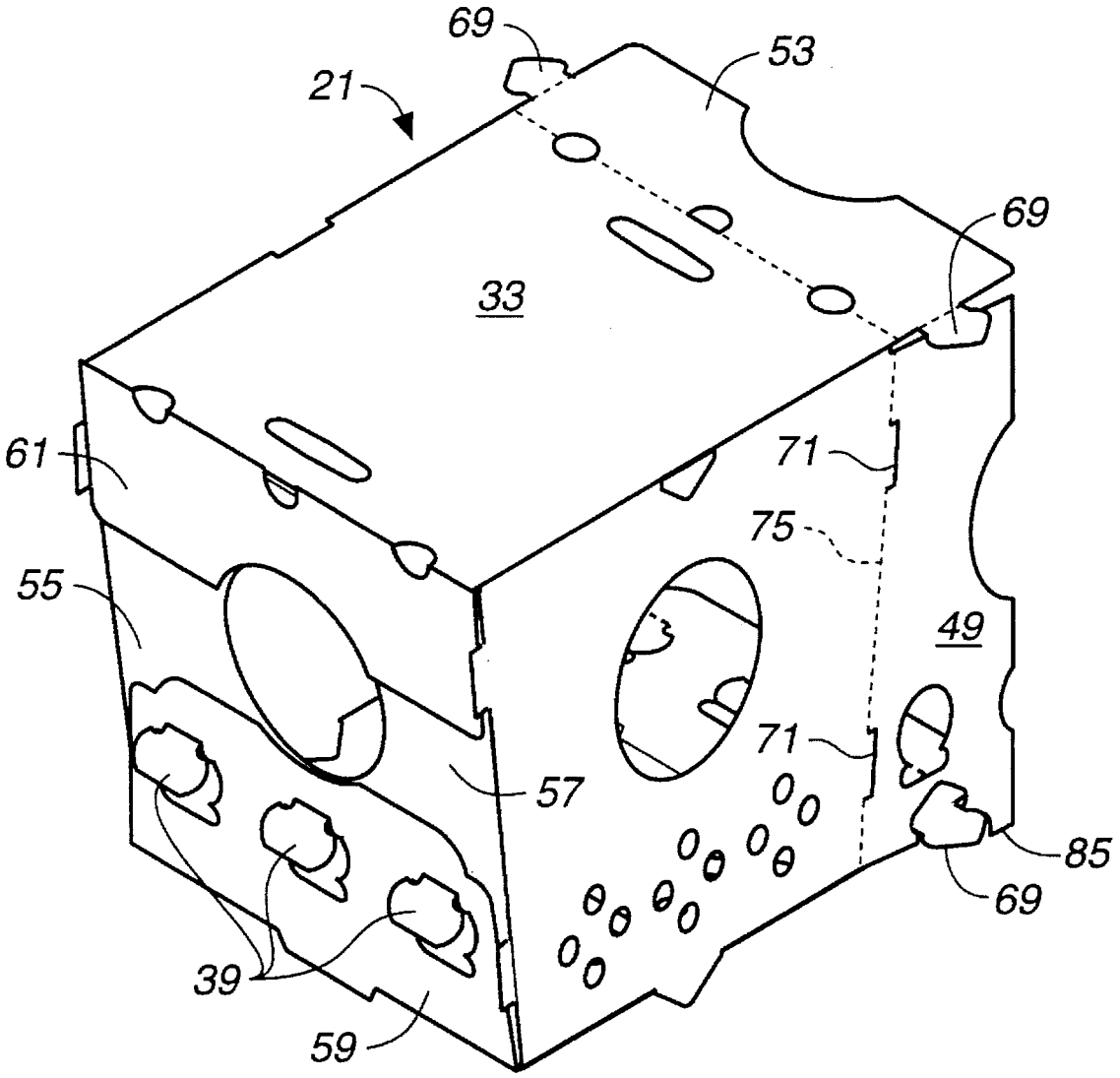
FIG. 12 is a perspective view of an assembled shipping and display box after it has been removed from the forming apparatus according to an embodiment of the present invention.

The tabs 69 at the left and right edges of the bottom panel 61 of the rear wall 31 are inserted into lower ones of the slots 71 on the rear left and right side corners 65 and 67, respectively. The tabs 69 at the left and right edges of the top panel 59 of the rear wall 31 are inserted into upper ones of the slots on the rear left and right side corners 65 and 67, respectively (FIG. 9).

Figure 15:
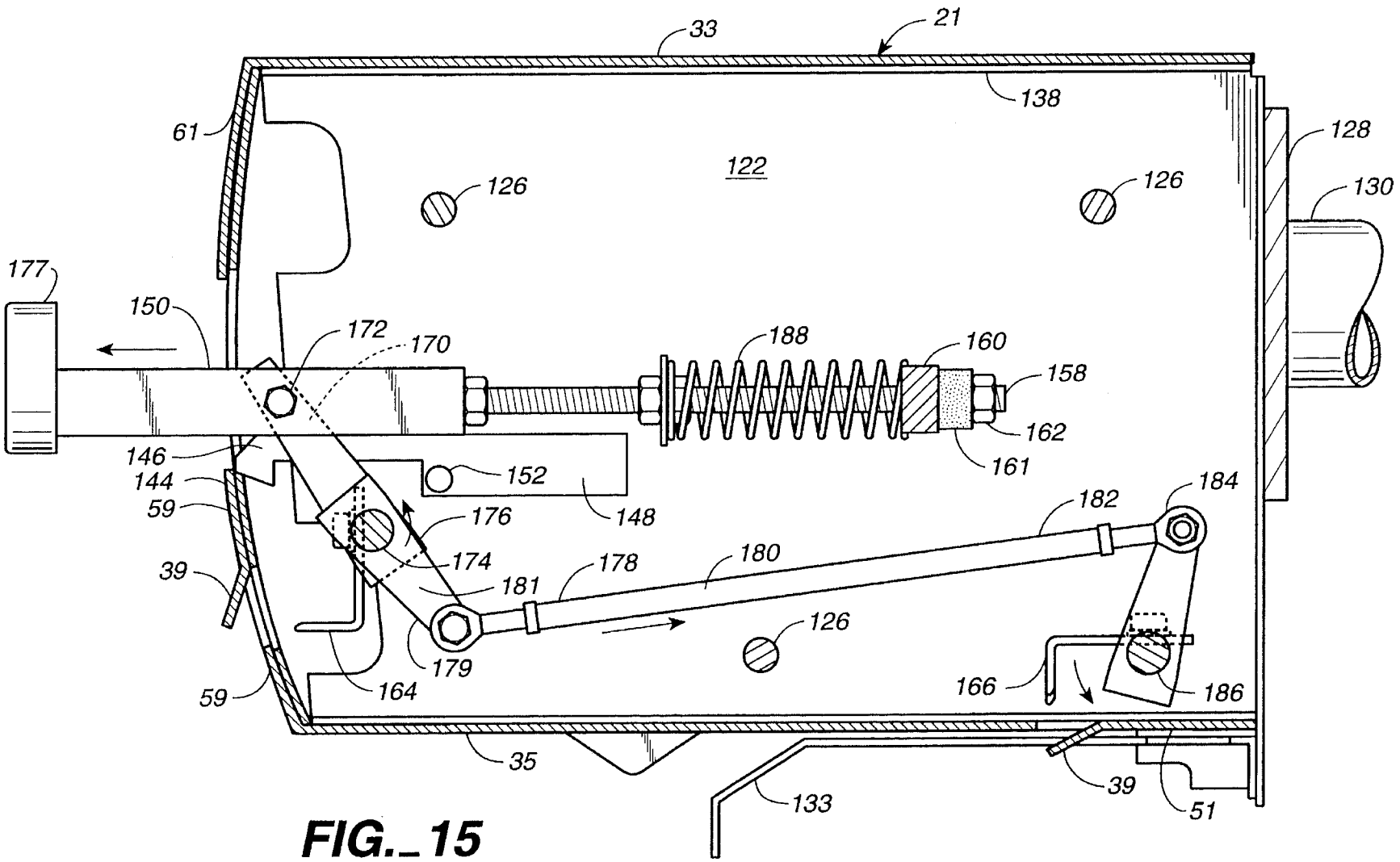
FIG. 15 is a cross-sectional side view of the forming apparatus and the shipping and display box just before the box is removed from the forming apparatus.

As can best be seen in FIGS. 3 and 15 and discussed previously, the top panel 59 bows outwardly. The outward bowing of the top panel 59 is preferably provided by virtue of the "memory" of the top panel 59, which would tend to unfold relative to the top and bottom walls 33 and 35 but is restrained at the left and right edges of the top panel 59 by the tabs 69 and slots 71. Center portion 144 of the top panel 59, which is not fastened down, tends to push outward as the top panel 59 tries to unfold, causing the top panel to bow outward at its center 144, relative to the constrained left and right edges.

The outward bowing (i.e., "memory") of the top panel 59 is used to hold the shipping and display box 21 on the forming apparatus 120 and to provide resistance against the forming apparatus 120 as the diverter tabs 39 are pushed outward by the forming apparatus 120 as will be discussed later. The center portion 144 of the top panel 59 is pushed behind the catcher plate hook 146 so that the shipping and display box 21 is held on the forming apparatus 120 (FIG. 13) and the center portion 144 of the top panel 59 is held inward. Generally, the center portion 144 of the top panel 59 is pushed behind the catcher plate hook 146 naturally as the top panel 59 is closed and the tabs 69 at the left and fight edges of the top panel 59 are inserted into upper ones of the slots on the rear left and right side corners 65 and 67. Another way for the user to push the top panel 59 behind the catcher plate hook 146 is to use their thumbs. By placing one thumb on the top panel 59 to the left of the catcher plate hook 146 and one thumb on the top panel 59 to the right of the catcher plate hook 146, the center portion 144 of the top panel 59 can be pushed behind the catcher plate hook 146.

Figure 13:
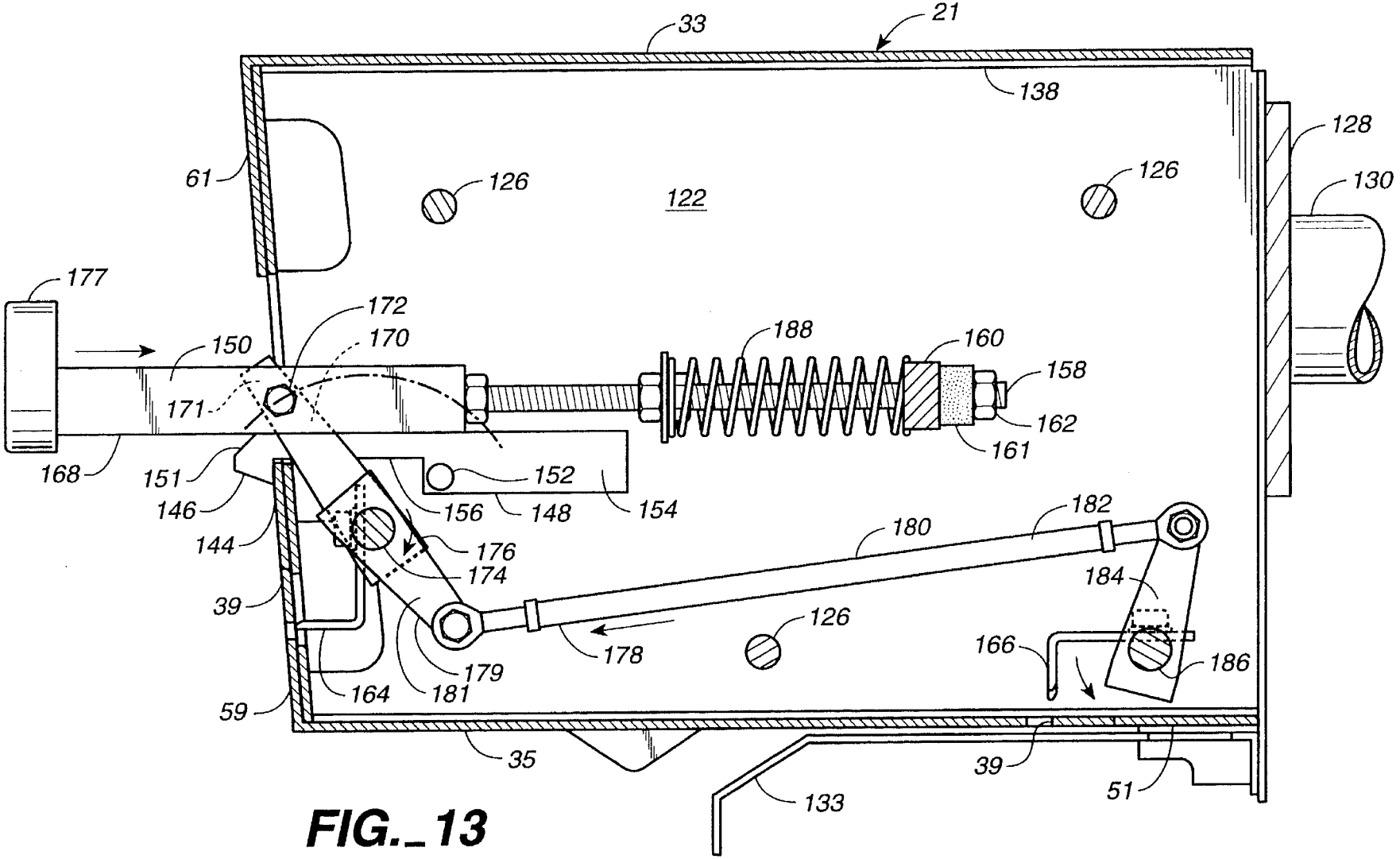
FIG. 13 is a cross-sectional side view of the forming apparatus and the shipping and display box taken at section 13—13 of FIG. 10.

Another aspect of the invention is that the catcher plate 148 is held down initially by the actuator bar 150 at contact point 151 (FIG. 13). The actuator bar 150 holds down the catcher plate 148 because the catcher plate 148 is tail weighted such that gravity causes the catcher 148 to rotate around pivot point 152 when no pressure is applied to the catcher plate. In other words, the aft portion 154 of the catcher plate 148 is heavier than the forward portion 156 having the catcher plate hook 146. The actuator bar 150 is slidably mounted at its aft end 158 in cross bar support 160. Also at the aft end of actuator bar 150 is a bumper 161 (preferably rubber) and a stroke adjustment knob 162. The bumper 161 prevents the stroke adjustment knob 162 from striking against the cross bar support 160. The stroke adjustment knob 162 can be used to adjust the initial location and travel of the actuator knob and thus the initial location and travel of the two sets of diverter tab levers 164 and 166.

Figure 14:
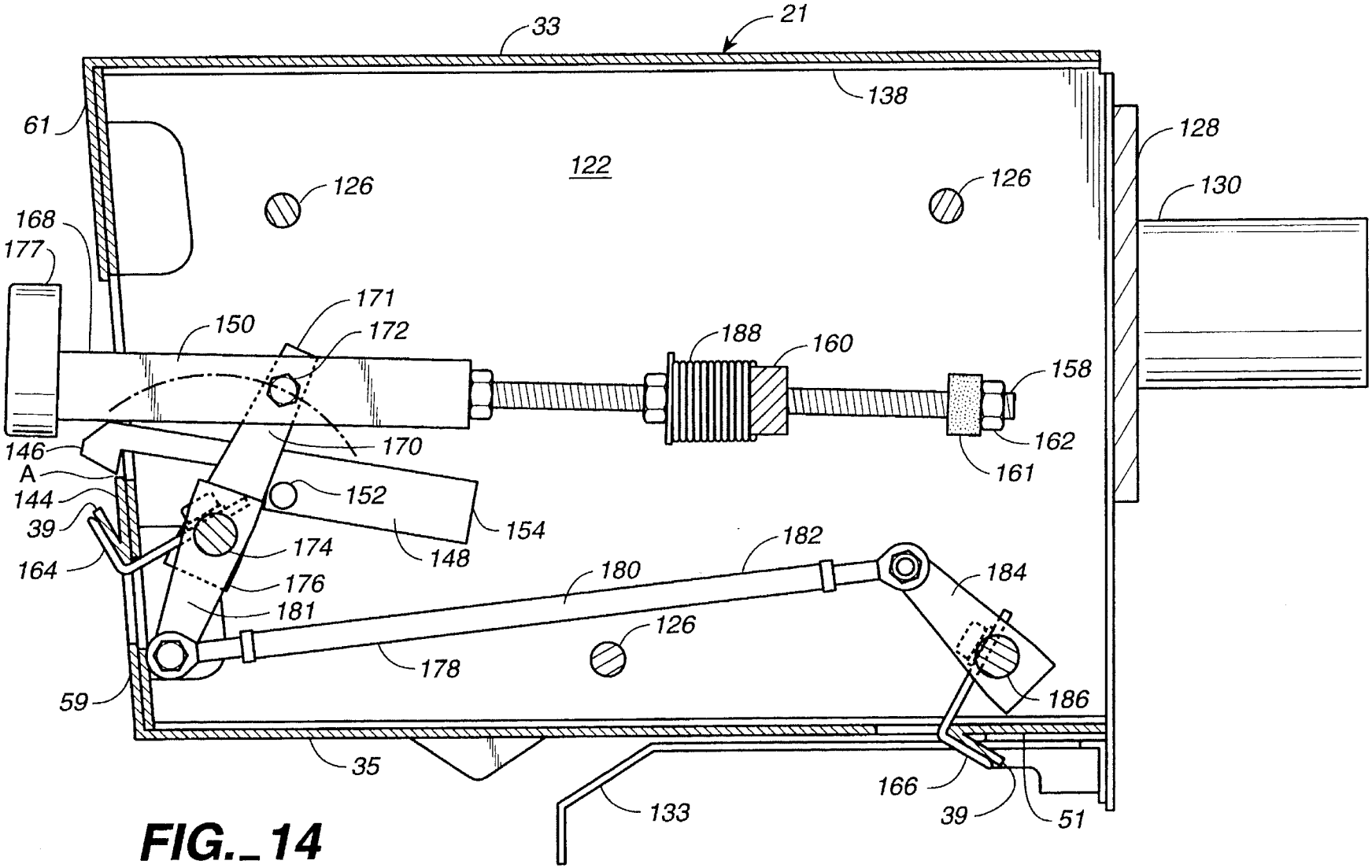
FIG. 14 is a cross-sectional side view of the forming apparatus and the shipping and display box taken at section 14—14 of FIG. 11.

The forward portion 168 of the actuator bar 150 is pivotally attached at the forward end 171 of actuator lever 170 at pivot point 172 (FIGS. 13–15). Actuator lever 170 is mounted on cross support member 174. Cross support member 174 is rotatably mounted in left forming side plate 122 and right forming side plate 124. The actuator lever 170 is mounted on cross support member 174 closer to its aft end 176 so that when the actuator pad 177 is pushed aft the forward end 171 of the actuator lever 170 travels upwardly along an arc centered around cross support member 174 (FIGS. 13 and 14).

Spaced along the cross support member 174 is a set of diverter tab levers 164. The diverter tab levers 164 correspond to the diverter tabs 39 on the top panel 59. The forward end 178 of actuator linkage 180 is rotatably attached to the aft end 179 of the actuator lever 181. At the aft end 182 of actuator linkage 180 is a tucker lever 184 mounted on cross support member 186. Cross support member 186 is rotatably mounted in left forming side plate 122 and right forming side plate 124. Spaced along the cross support member 186 is a set of diverter tab levers 166. The diverter tab levers 166 correspond to the diverter tabs 39 on the top panel 51.

With the novel configuration just described several movements occur simultaneously as the actuator pad 177 is pushed aft in the forming apparatus 120 (FIG. 13). The aft end 179 of the actuator lever 181 rotates clockwise about the cross support member 174 pushing the set of diverter tab levers 164 against the diverter tabs 39 of the top panel 59. The actuator linkage 180 is pulled forward by the actuator lever 181 causing the tucker lever 184 to rotate counterclockwise about the cross support member 186 pushing the set of diverter tab levers 166 against the diverter tabs 39 of the top panel 51. The diverter tabs 39 are pushed away from the top panels 51 and 59. Initially, the catcher plate hook 146 provides resistance against the top panel 59 so that the diverter tabs 39 can be pushed out. Likewise, the bottom guide plate provides resistance against the top panel 51 so that the diverter tabs 39 can be pushed out. At the full extent of the actuator bar's 150 travel aft, the diverter tab levers 164 and 166 tuck the diverter tabs back against the outside surface of the top panel 59 and top panel 51, respectively (FIG. 14).

As the actuator lever 170 travels aft, it moves through an arc centered around cross support member 174. The pivot point 172 begins at about the eleven o'clock position, as the pivot point 172 moves through the twelve o'clock position toward the one o'clock position it raises up. As the actuator bar 150 raises up, it is no longer in contact with the catcher plate 148 at contact point 151. As the set of diverter tab levers 164 tucks the diverter tabs 39 against the top panel 59, it also pulls the top panel 59 in enough so that the center portion 144 of top panel 59 is no longer in contact with or applying pressure against the catcher plate hook 146 (FIG. 14). As a result of the tail weighting of the catcher plate 148, the catcher plate pivots clockwise freely around pivot point 152 in response to gravity. When the catcher plate 148 has rotated about pivot point 152 there is a clearance A between the tip of the catcher plate hook 146 and the center portion 144 of the top panel 59 (FIG. 14). The automatic release of the catcher plate hook 146 is particularly advantageous because the user can then slip the shipping and display box 21 off the forming apparatus 120 without having to perform an additional step to release a holding mechanism.

The actuator pad 177 is then released so that actuator spring 188 returns the actuator bar 150, sets of diverter tab levers 164,166 and all other components to their initial positions (FIG. 15). As a result of diverter tab levers 164 releasing from the diverter tabs 39 of the top panel 59 and the "memory" (i.e., resiliency) in the top panel 59, the top panel 59 returns to its previous bowed condition before the actuator bar 150 contacts the catcher plate 148 and pushes the catcher plate 148 back down to its initial position (FIG. 15). As a result of the top panel 59 being forward of the catcher plate hook 146, the shipping and display box can be removed from the forming apparatus 120. Because of the resiliency in the diverter tabs 39, the diverter tabs assume a position extending outwardly from the front and rear walls 29 and 31 as seen in FIGS. 3, 6, 7, 12 and 15.

In short, as the actuator pad 177 is pushed in, the diverter tab levers 164,166 push the diverter tabs 39 out and pull in slightly on the top panel 59. As the diverter tab levers do so, the pressure caused by the top panel 59 on the catcher plate hook 146 is removed and the catcher plate hook 146 rotates up because of its tail weighting. When the actuator pad 177 is released, the diverter tab levers 164, 166 retract and the natural resiliency in the top panel 59 causes it to bow out beyond the tip of the catcher plate hook 146. As a result the box 21 can be removed from the forming apparatus 120.

The novel forming apparatus 120 just described is particularly advantageous because it is not motorized or electrically operated and thus can be produced and used cheaply. Likewise, the apparatus can be used remote from power sources such as in a produce field. However, the apparatus can be motorized or electrically operated to speed up the operation and reduce the work load on a user. For example, the actuator bar 150 can be replaced with a hydraulic, pneumatic, or electric actuator or the like. In addition, the container insert guides 132 can be adapted to fold the blank 23 up along side of the left forming side plate 122 and right forming side plate 124. Means can be added to fold the bottom panel 33 across the top of the forming apparatus 120. The orientation of the diverter tab levers 164, 166 can be changed so that diverter tabs that may be located on different portions of a shipping and display box can be extended out.

After the shipping and display box 21 is removed from the apparatus (FIG. 12), the panels that form the front wall are open so that the shipping and display box can be loaded with produce. After loading, the left and right panels 47 (not shown in FIG. 12) and 49 of the front wall 29 are folded relative to the front left and right side corners 73 and 75, respectively. The tabs 85 on the upper edges of the left and right panels are inserted into the opening 83 at the top front corner 79 formed by the stacking tab 77 (not shown in FIG. 12). The tabs 69 at the left and right edges of the bottom panel 53 of the front wall 29 are inserted into lower ones of the slots 71 on the front left and fight side corners 73 (not shown in FIG. 12) and 75, respectively. The tabs 69 at the left and right edges of the top panel 51 (not shown in FIG. 12) of the front wall 29 are inserted into upper ones of the slots 71 on the front left and right side corners 73 and 75, respectively. To facilitate folding of the left panels 47 and 55 and the right panels 49 and 57 relative to the top panels 51 and 59, relief holes 115, seen in FIG. 2, are preferably provided at the corners defined by those panels. The relief holes 115 distribute stresses during folding and thus permit the panels to be folded without crushing or tearing of the box forming material at the corners. Relief slots 117 are preferably provided at the corners defined by the bottom panels 53 and 61 and the left panels 47 and 55 to facilitate folding of those panels.

Upon forming the shipping and display box 21 in the manner described above, the stacking tabs 77 and the registration tabs 103 project upwardly in the desired manner (FIG. 1). The holes 63 and recesses 63' align with the openings defined by the opened diverter tabs 39 and the removed upper portions 39' of the diverter tabs. Further, the recesses 64 align with the corner drain holes 41 (FIG. 5). The blank 23 for forming the shipping and display box 21 thus offers an easily assembled, highly sturdy structure.

When the shipping and display box is used to transport fresh products, it is typical to provide an absorbent pad (not shown) inside the bottom of the shipping and display box to hold water so that the fresh product will be in contact with the water in the pad. As noted above, fresh products in multiple stacks of shipping and display boxes 21 may be simultaneously watered or "hydro-cooled" to maintain freshness of the products by watering a top level of the multiple boxes and allowing the water to flow down to lower boxes through the various drain holes, diverter tabs, etc. (FIG. 7).

The foregoing has described the principles, preferred embodiments and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of the present invention as defined by the following claims.

What is claimed is:

1. An apparatus for extending diverter tabs outwardly from the walls of a shipping and display box, said apparatus comprising:

means for supporting a blank used for forming the shipping and display box;

means for holding the blank on the apparatus;

means for extending the diverter tabs outwardly from the box walls to create openings through the shipping and display box and releasing the holding means so that the blank can be removed from the apparatus; and actuator means for actuating the extending means against the diverter tabs, wherein as the actuator mans moves substantially translationally the extending means moves rotationally.

2. A method for forming a shipping and display box of the type having diverter tabs that extend outwardly from the box walls, said method comprising:

supporting a blank used for forming the shipping and display box in a forming apparatus;

folding the blank on the forming apparatus to form the box walls;

holding the blank substantially stationary on the forming apparatus;

extending the diverter tabs outwardly from the box walls with the forming apparatus to create openings through the shipping and display box; and releasing the blank subsequent to the diverter tabs being fully extended outward from the box wall so that it can be removed from the forming apparatus.

3. An apparatus for forming a shipping and display box of the type having diverter tabs that extend outwardly from the box walls, said forming apparatus comprising:

a guide plate for supporting a blank used for forming the shipping and display box;

a catcher plate used for holding the blank on the forming apparatus;

a diverter tab lever for extending the diverter tabs outwardly from the box walls to create openings through the shipping and display box; and an actuator for urging the diverter tab lever against the diverter tabs, the actuator allows the catcher plate to be released so that the blank can be removed from the forming apparatus, wherein the catcher plate provides resistance against the blank as the diverter tab lever pushes the diverter tabs outwardly from the box walls and the diverter tab lever releases the resistance against the catcher plate after the diverter tabs have been fully extended such that the catcher plate is released and the blank can be removed from the forming apparatus.

4. An apparatus for forming a shipping and display box of the type having diverter tabs that extend outwardly from the box walls, said forming apparatus comprising:

a guide plate for supporting a blank used for forming the shipping and display box;

a catcher plate used for holding the blank on the forming apparatus;

a diverter tab lever for extending the diverter tabs outwardly from the box walls to create openings through the shipping and display box; and an actuator for urging the diverter tab lever against the diverter tabs, the actuator allows the catcher plate to be released so that the blank can be removed from the forming apparatus, wherein as the actuator moves substantially translationally, the diverter tab lever moves rotationally.

5. An apparatus for forming a shipping and display box of the type having diverters tabs that extend outwardly from the box walls, said forming apparatus comprising:

a guide plate for supporting a blank used for forming the shipping and display box;

a catcher plate used for holding the blank on the forming apparatus; a diverter tab lever for extending the diverter tabs outwardly from the box walls to create openings through the shipping and display box; and an actuator for urging the diverter tab lever tab against the diverter tabs, the actuator allows the catcher plate to be released so that the blank can be removed from the forming apparatus wherein the diverter tab lever comprises:

a first set of diverter tab levers joined to the actuator by an actuator lever; and a second set of diverter tab levers joined to the first set of diverter tab levers by actuator linkage.

6. The apparatus of claim 5 wherein:

the actuator lever rotates about a rotation point, a first end of the actuator lever being longer than a second end of the actuator lever;

the actuator being pivotally joined to the first end of the actuator lever on a first side of the rotation point;

the first set of diverter tab levers being joined to the actuator lever;

the actuator linkage being pivotally joined at a first end to the second end of the actuator lever on a second side of the rotation point; and the second set of diverter tab levers being joined to a second end of the actuator linkage such that as the actuator is moved substantially translationally it rises along an arc centered about the rotation point and the first set of diverter tab levers and the second set of diverter tab levers move rotationally toward the diverter tabs.

7. The apparatus of claim 6 wherein the catcher plate is weighted more on a second end than a first end such that as the actuator rises along the arc the catcher plate rotates around a pivot point.

8. An apparatus for forming a shipping and display box of the type having diverter tabs that extend outwardly from the box walls, said forming apparatus comprising:

a guide plate for supporting a blank used for forming the shipping and display box;

a catcher plate used for holding the blank on the forming apparatus;

a first set of diverter tab levers for extending a first set of diverter tabs outwardly from a first box wall;

a second set of diverter tab levers joined to the first set of diverter tab levers by an actuator linkage for extending a second set of diverter tabs outwardly from a second box wall; and an actuator joined to the first set of diverter tab levers by an actuator lever for urging the first set of diverter tab levers against the first set of diverter tabs and the second set of diverter tab levers against the second set of diverter tabs, the actuator allows the catcher plate to be released so that the blank can be removed from the forming apparatus.

9. The apparatus of claim 8 wherein:

the actuator lever rotates about a rotation point, a first end of the actuator lever being longer than a second end of the actuator lever;

the actuator being pivotally joined to the first end of the actuator lever on a first side of the rotation point;

the first set of diverter tab levers being joined to the actuator lever;

the actuator linkage being pivotally joined at a first end to the second end of the actuator lever on a second side of the rotation point; and the second set of diverter tab levers being joined to a second end of the actuator linkage such that as the actuator is moved substantially translationally it rises along an arc centered about the rotation point and the first set of diverter tab levers and the second set of diverter tab levers move rotationally toward the diverter tabs.

10. The apparatus of claim 9 wherein the catcher plate is weighted more on a second end than a first end such that as the actuator rises along the arc the catcher plate rotates around a pivot point.

* * * * *